US006967314B2

(12) United States Patent
Sauter et al.

(10) Patent No.: US 6,967,314 B2
(45) Date of Patent: Nov. 22, 2005

(54) PROGRAMMABLE POWER LEVEL CONTROL FOR A COOKING APPLIANCE

(75) Inventors: Kenneth E. Sauter, Ooltewah, TN (US); Inho Andy Shin, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/606,072

(22) Filed: Jun. 26, 2003

(65) Prior Publication Data

US 2004/0262289 A1 Dec. 30, 2004

(51) Int. Cl.[7] ..... H05B 3/02; H05B 3/68
(52) U.S. Cl. ..... 219/483; 219/448.12
(58) Field of Search ..... 219/482, 483, 219/486, 487, 489, 490, 492, 448.12, 448.13, 219/460.1, 445.1

(56) References Cited

U.S. PATENT DOCUMENTS 4,266,118 A 5/1981 Takase et al.
4,410,795 A * 10/1983 Ueda ..... 219/492
4,786,799 A * 11/1988 Welle et al. ..... 219/486
4,902,878 A 2/1990 Smith et al.
5,073,701 A * 12/1991 Ljunggren ..... 219/446.1
5,378,874 A 1/1995 Holling et al.
5,528,018 A 6/1996 Burkett et al.
5,746,114 A 5/1998 Harris
5,877,477 A 3/1999 Petty et al.
6,005,229 A 12/1999 Brown et al.
6,080,972 A 6/2000 May
6,198,080 B1 3/2001 Rice et al.
6,236,025 B1 5/2001 Berkcan et al.
6,252,206 B1 6/2001 Leukhardt, III et al.
6,255,630 B1 7/2001 Barnes et al.
6,294,994 B1 * 9/2001 Hoellerich ..... 340/540
6,297,482 B1 * 10/2001 Becker ..... 219/445.1
6,717,117 B2 * 4/2004 Blanchard et al. ..... 219/492

* cited by examiner

*Primary Examiner*—Sang Y. Paik
(74) *Attorney, Agent, or Firm*—Diederiks & Whitelaw, PLC

(57) ABSTRACT

A cooking appliance includes a cooktop having at least one heating element and a controller capable of automatically performing a cooking process by operating the heating element at multiple power levels for multiple time periods. More specifically, upon activation, a consumer, through manipulation of a control, can select an initial power level and an initial time duration for the initial power level. Once the initial power level is selected, a second power level and second time duration may be selected. With this arrangement, the controller will operate the heating element at the initial, high power level for the first time duration. Once the initial time period has elapsed, the controller automatically lowers the temperature of the heating element to finish the cooking process for the second time duration.

18 Claims, 3 Drawing Sheets

PROGRAMMABLE POWER LEVEL CONTROL FOR A COOKING APPLIANCE

BACKGROUND OF THE INVENTION

1. Field of the Invention

The present invention pertains to the art of cooking appliances and, more particularly, to a cooking appliance including a control for operating a heating element at multiple power levels for multiple time periods.

2. Discussion of the Prior Art

In general, establishing a selected power level for a heating element in a cooking appliance is known. However, maintaining the selected power level for the entire duration of a cooking process is not always desirable. Specifically, when cooking rice, pasta or other liquid based food items, it is often necessary to bring a liquid to a boil using an initial, high power setting and thereafter simmer at a second or lower power setting for a prescribed period. In today's fast paced society, there is seldom time to continuously monitor the contents of a pot. Often times the pot will boil over, causing the contents to run onto the heated surfaces of a stove. Other times, the pot is left to boil for so long that the contents boil away, leaving behind a charred mess.

The prior art teaches a variety of methods for providing a more convenient means of cooking food on a cooktop. One example is provided by U.S. Pat. No. 5,746,114 disclosing an intelligent cooking system. The cooking system includes various cooking implements, such as pots and pans, each having an associated temperature monitor. The system also includes a cooktop having a plurality of burners and a controller that is linked between the cooktop and the temperature monitors to maintain a desired temperature in the associated pot or pan. While effective, this system is large, complex and expensive. In the highly competitive field of cooking appliances, increased cost and complexity can be significant, disadvantageous features.

Another method disclosed in the prior art is embodied in U.S. Pat. No. 6,236,025 directed to an acoustic sensing system for detecting boiling in a particular cooking implement. As disclosed, an acoustic sensor is mounted in a cooktop range and configured to detect acoustic frequencies that are characteristic of emissions resulting from heating and boiling of water. While effective to a large extent, not all cooking processes include a boiling stage. In addition, as with the previous method, there are both high costs and reliability concerns with this system.

Based on the above, there exists a need in the art for a cooking appliance including a cooktop and a controller capable of establishing multiple power levels for at least one heating element of the cooktop, with each power level having an associated time duration of operation. More specifically, there exists a need for a cooking appliance having a controller that can establish an initial high power level for a first time period of a cooking operation and then automatically lower to a second power level for the remainder of the cooking operation.

SUMMARY OF THE INVENTION

The present invention is directed to a cooking appliance having a cooktop including at least one heating element, a control panel having at least one control element and a controller linked between the at least one heating element and the control element. More specifically, the at least one control element is associated with establishing a desired power level for the at least one heating element. In accordance with a preferred embodiment of the present invention, the controller is adapted to establish first and second settings for the at least one heating element. Preferably, the first setting establishes an initial power level for a first selected time period of a cooking operation, while the second setting establishes a second, lower power level for the remainder of the cooking operation. With this arrangement, the cooking operation is conducted without requiring constant monitoring by a consumer.

The cooking appliance, in the most preferred embodiment, includes first and second sets of slew buttons arranged on the control element. More specifically, the first set of slew buttons includes a first slew button for selecting the power level and a second slew button for selecting the time period. The second set of slew buttons includes an up arrow slew button and a down arrow slew button. With this arrangement, a consumer can activate the heating element and, through manipulation of the up and down arrow slew buttons, establish a desired initial heating element temperature that functions as a pre-heat process, or simply to establish an initial high cooking temperature.

Once the initial power level is selected, manipulation of the time slew button will establish a desired time duration for the initial power level. Once the initial power level and initial time are selected, following similar steps, a second or final power level can be established for completing the cooking operation. If a user fails to select a second power level, the controller will preferably default to a predetermined lower power setting. In accordance with the most preferred form of the invention, the second power level must be lower than the initial power level as the control will not permit selection of a higher, second power level.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
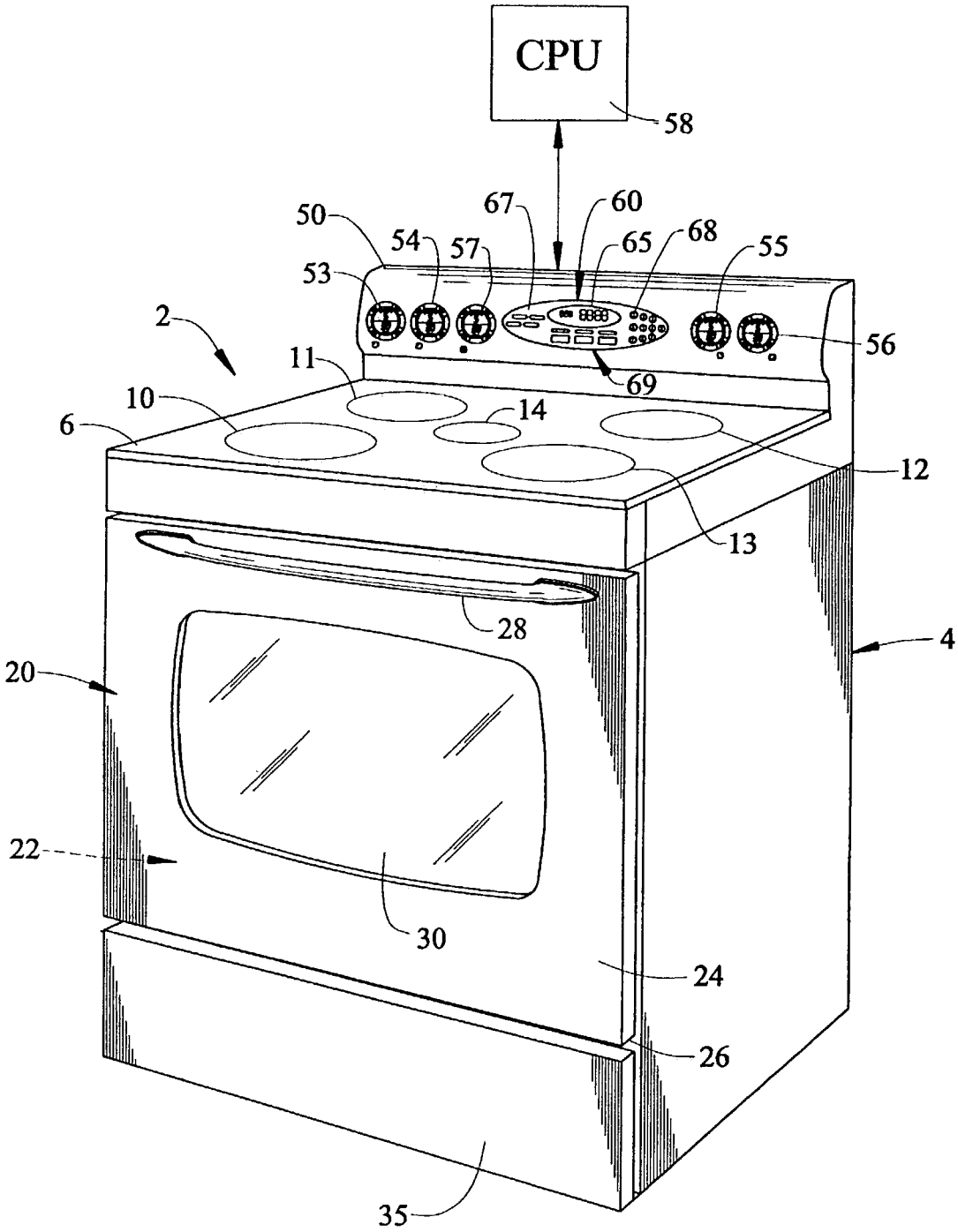
FIG. 1 is an upper right perspective view of a cooking appliance including a cooktop having a plurality of control elements arranged on a control panel constructed in accordance with the present invention.

With initial reference to FIG. 1, a cooking appliance 2, generally taking the form of an oven range, includes a cabinet shell 4 provided with a cooktop 6. As illustrated, appliance 2 constitutes a free-standing electric range such that cooktop 6 is provided with a plurality of electric heating elements or zones 10–14. At this point, it should be noted that, although appliance 2 is shown to constitute a free-standing range, the invention is equally applicable to various other types of cooking appliances including slide-in ranges, kitchen island cooktops, and the like.

In a preferred embodiment, appliance 2 includes an oven 20 having an interior oven cavity 22. In a manner known in the art, oven 20 has associated therewith a door 24 which can be pivoted at a lower portion 26 by means of a handle 28. Door 24 preferably includes a window or transparent zone 30 for viewing the contents of oven 20 when door 24 is closed. In a manner also known in the art, appliance 2 includes a drawer or bin 35 arranged below oven 20. More specifically, drawer or bin 35 is adapted to be slid in and out of shell 4 in order to access an interior storage compartment (not shown) therein.

In the embodiment shown, appliance 2 includes a control panel 50 having arranged thereon a plurality of control elements 53–57 which, as will be discussed more fully below, interact with a controller or CPU 58 to set a desired power level for respective ones of heating elements 10–13. Control panel 50 further includes a central display 60 including a digital display portion 65, a plurality of oven control buttons generally indicated at 67 arranged on one side of central display 60, a numeric keypad 68 arranged on an opposite side of central display 60, and a plurality of mode select buttons 69 arranged below digital display 65.

Figure 2:
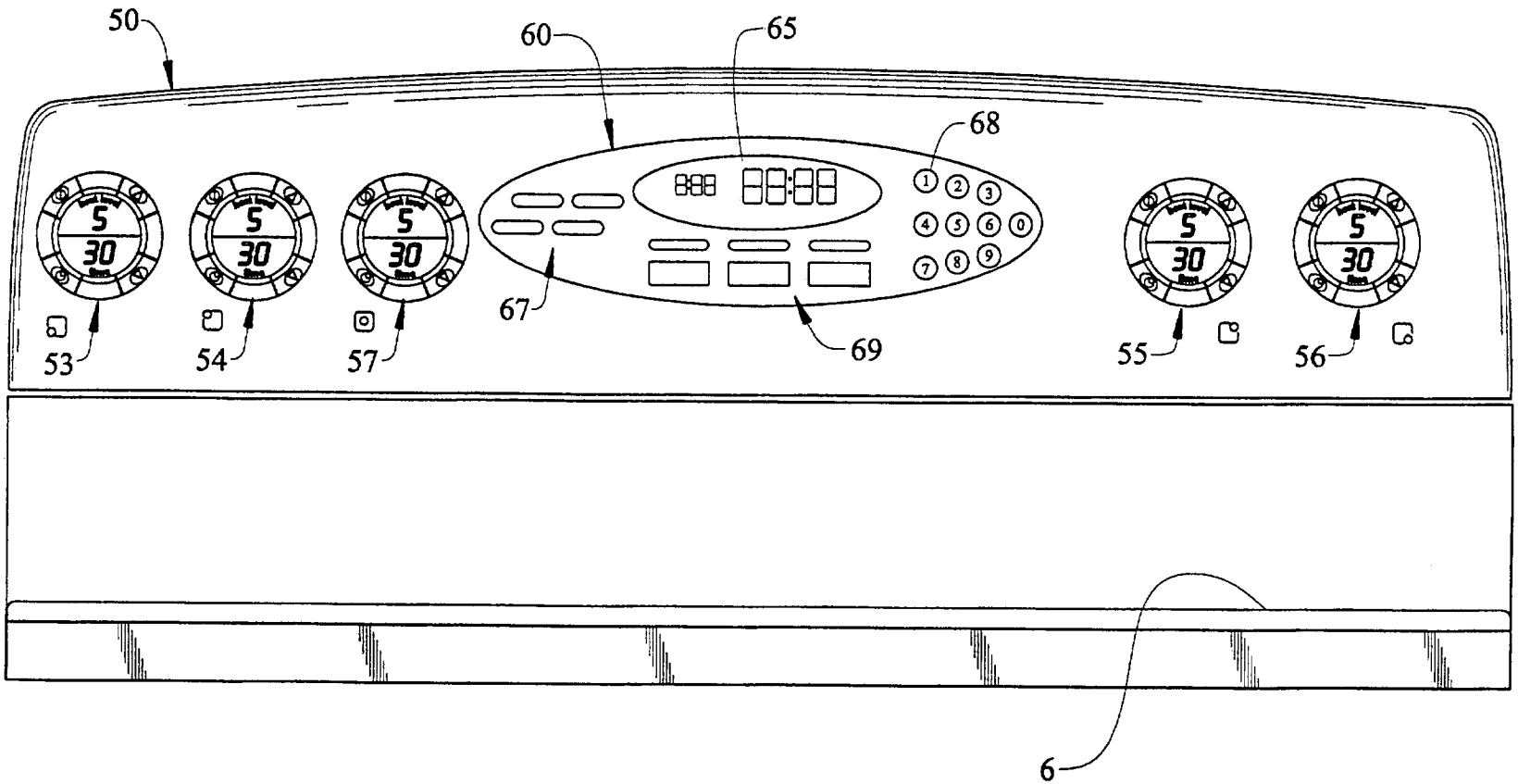
FIG. 2 is an enlarged, plan view of the control panel and the plurality of control elements of FIG. 1.
Figure 3:
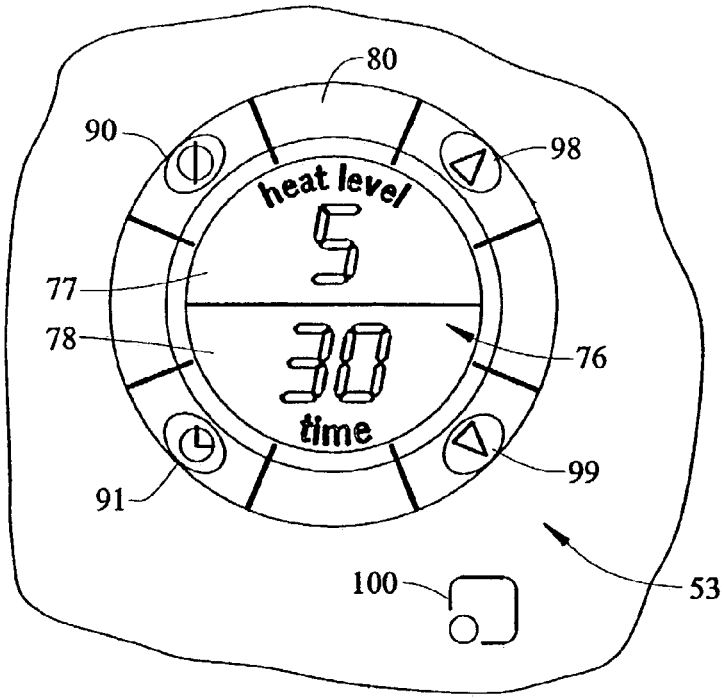
FIG. 3 is an enlarged, plan view of one of the plurality of control elements constructed in accordance with one embodiment of the present invention.

Reference will now be made to FIGS. 2 and 3 in describing the specific structure of control elements 53–57 arranged on either side of central display 60 of control panel 50. Since the structure of each control element 53–57 is identical, a detailed description of control element 53 will be made and it is to be understood that control elements 54–57 have commensurate structure. In the embodiment shown, control element 53 includes a display portion 76 having an upper section 77 and a lower section 78. In accordance with one preferred embodiment, upper section 77 provides an indication of a selected power level for the associated, in this case, heating element 10 and lower section 78 provides an indication of the time remaining for operating heating element 10 at that particular power level. As shown, extending about display portion 76 is an outer ring 80 having arranged thereon first and second sets of slew buttons 90, 91 and 98, 99. In accordance with the most preferred form of the invention, first set of slew buttons 90 and 91 are associated with selecting between establishing a power level and an operating time for that power level respectively. Actually, slew button 90 serves a dual purpose in that slew button 90 also acts as an on/off switch for heating element 10. Second set of slew buttons 98 and 99 are constituted by up and down arrows respectively which permit a user to increase or decrease the desired power level or time period depending upon the current operating mode of control element 53. Finally, arranged below control element 53 is an icon 100 which indicates the heating element location associated with operation of the particular control element.

Figure 4:
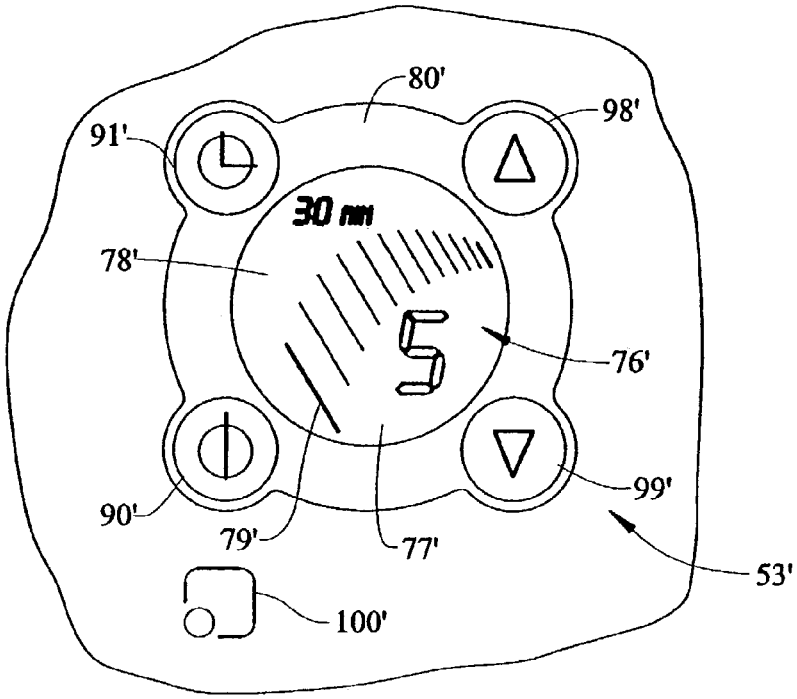
FIG. 4 is an enlarged, plan view of a control element constructed in accordance with a second embodiment of the present invention.

In accordance with another embodiment of the present invention, the control element can take the form shown indicated generally at 53' in FIG. 4. In a manner similar to that described for the previous embodiment, control element 53' includes a display portion 76' having a power level display section 77' and a time remaining display section 78'. In accordance with this form of the invention, control element 53' includes a graphic design 79' which separates power level display section 77' and time remaining display section 78'. Extending about display portion 76' is an outer ring 80' having arranged thereon first and second sets of slew buttons 90', 91' and 98', 99'. In a manner analogous to that set forth above, slew button 90' and 91' are used to toggle between inputting a desired power level and a desired time period, while slew buttons 98' and 99' are used to increase or decrease the desired power level and/or time period respectively. Finally, an icon 100' is provided at a lower portion of control element 53 to indicate the corresponding heating element associated with operation of the particular control element.

Having described a preferred construction of cooking appliance 2 and, more particularly control elements 53–57, a preferred method of operation will be set forth with particular reference to FIGS. 1 and 3. In order to commence a cooking operation, a user activates on/off button 90 which causes display 76 to initially display a zero in power level section 77 and a zero in time section 78. In accordance with one preferred embodiment, initial manipulation of either slew button 98 or 99 causes controller 58 to jump to a particular power level setting, for example 5, which is displayed in power level display section 77. Further manipulation of slew button 98 or 99 will cause the power level to either increase, i.e., through manipulation of slew button 98, or decrease, through manipulation of slew button 99. After reaching a desired initial power level, a pause for a prescribed period, for example 4 seconds, will cause display 76 within time level section 78 to flash. At this time, the user can, if desired, set a time duration for the previously selected power level through the operation of slew button 91.

As indicated above, after the selection of the initial power level, the user is presented with the option of setting the time duration for that initial power level. In a manner similar to that previously described, after depressing time pad 91, the user can either increase, through manipulation of slew button 98, or decrease, through manipulation of slew button 99, the amount of time of the initial power level. After the desired time duration has been programmed into controller 58 and after a pause for a predetermined time period, for example 3 seconds, power level display section 77 will begin to flash.

At this point in the operation, the user is presented with the option of selecting a second or final power level for the associated heating element. In accordance with the most preferred form of the invention, the user has the option of selecting a lower power level such that the final part of the cooking operation will be performed at a lower power setting. Accordingly, manipulation of slew button 99 will lower the power level displayed in section 77 to a desired second level. The option of operating the heating element at a second, higher level is, in the most preferred embodiment of the invention, not available. In further accordance with the invention, failure to select a second power level will cause controller 58 to default to a predetermined lower power level, e.g. a level 1 or 2 setting. If at any point during the cooking operation the user desires to alter the current power setting, manipulation of either slew button 98 or 99 will cause the present power level to increase or decrease correspondingly. Finally, controller 58 will terminate operation of the heating element after a predetermined time period, for example 4–6 hours, if the user either fails or neglects to turn off cooktop 6.

With this arrangement, it should be readily apparent that a consumer can pre-set a multi-level cooking operation for each heating element 10–14. That is, a first power level for performing an initial pre-heat process or other high temperature cooking operation is automatically followed by a second lower temperature cooking operation, such as, for example, a simmering process. In this manner, the consumer is able to perform other activities in and out of the kitchen without fear that a pot will boil over onto the cooking surface or the food will boil away leaving behind a charred mess. Although described with reference to a preferred embodiment of the invention, it should be readily understood that various changes and/or modifications can be made to the invention without departing from the spirit thereof. For instance, the particular arrangement of the slew buttons, the overall configuration of the control element, and the display graphics could be readily modified without departing from the scope of the present invention. In addition, control elements for the heating elements could be linked to the oven display to provide the user with a numerical or alpha/numeric indication of the present power setting and time remaining. In general, the invention is only intended to be limited by the scope of the following claims.

What is claimed is:

1. A cooking appliance comprising:

a cooktop;

at least one selectively controllable heating element arranged on the cooktop;

a controller for operating the at least one heating element; and at least one control element, linked to the controller, for inputting first and second settings for the heating element, wherein said first setting establishes a first power level operated for a first time duration and the second setting establishes a second, active power level operated for a second time duration, wherein a cooking operation covering the first and second power levels is automatically performed, wherein the controller automatically establishes the second power level if the second power level is not selected through the at least one control element.

2. The cooking appliance according to claim 1, wherein the second selected power level is less than the first selected power level.

3. The cooking appliance according to claim 1, wherein the controller automatically performs a shut down function, terminating operation of the at least one heating element after a period of inactivity.

4. The cooking appliance according to claim 3, wherein the period of inactivity is from 4 to 6 hours.

5. The cooking appliance according to claim 1, wherein the at least one control element includes a digital display.

6. The cooking appliance according to claim 5, wherein the digital display includes first and second display sections, with said first display section indicating a power level and the second display section indicating the time duration.

7. The cooking appliance according to claim 1, wherein the at least one control element includes first and second sets of slew buttons.

8. The cooking appliance according to claim 7, wherein the first set of slew buttons include a first button for selecting a power level input option and a second button for selecting a time duration input option.

9. The cooking appliance according to claim 8, wherein the second set of slew buttons include a first button for increasing power level and time duration settings and a second button for decreasing power level and time duration settings.

10. The cooking appliance according to claim 1, wherein the first selected power level and first selected time period constitute a pre-heat process.

11. A method of performing a cooking operation on a cooktop including a controller and at least one heating element comprising:

selecting a first power level for the at least one heating element;

selecting a first time duration for operating the at least one heating element at the first power level;

operating the at least one heating element at the first power level for the first time duration;

automatically switching the at least one heating element to a second, active power level for a second time duration following the first time duration wherein the second power level is automatically established by the controller to be lower than the first power level if the second power level is not selected; and terminating the cooking operation of the at least one heating element at the end of the second time duration.

12. The method of claim 11, further comprising:

selecting a second power level for the at least one heating element; and selecting a second time duration for operating the at least one heating element at the second power level.

13. The method of claim 11, wherein the second time duration is automatically established by the controller to be between 4 and 6 hours.

14. The method of claim 11, further comprising: displaying the first power level and the first time duration on a display formed as part of the control element.

15. The method of claim 14, further comprising:

pausing after selecting the first power level; and flashing the first power level on the display.

16. The method of claim 15, further comprising: displaying the second power level and second time duration on the display.

17. The method of claim 11, wherein selecting the second power level requires selecting a power level lower than the first power level.

18. The method of claim 11, wherein the first and second power levels, and first and second time duration are selected through manipulation of a pair of slew buttons provided on a control element for the at least one heating element.

* * * * *